United States Patent [19]

Aoki et al.

[11] 4,455,639

[45] Jun. 19, 1984

[54] MOVING COIL TYPE PICKUP CARTRIDGE

[75] Inventors: Naohisa Aoki; Akira Matui, both of Mitaka, Japan

[73] Assignee: Nippon Columbia Company, Ltd., Tokyo, Japan

[21] Appl. No.: 524,699

[22] Filed: Aug. 22, 1983

Related U.S. Application Data

[63] Continuation of Ser. No. 240,227, Mar. 3, 1981, abandoned.

[51] Int. Cl.[3] ..... H04R 9/16

[52] U.S. Cl. ..... 369/147; 369/170

[58] Field of Search ..... 369/147, 146, 170

[56] References Cited

U.S. PATENT DOCUMENTS 4,161,631 7/1979 Matsuda ..... 369/147

4,237,349 12/1980 Hansen ..... 369/147

FOREIGN PATENT DOCUMENTS 55-46663 4/1980 Japan ..... 369/147

*Primary Examiner*—Alan Faber

*Attorney, Agent, or Firm*—Murray Schaffer

[57] ABSTRACT

In a moving-coil type pickup cartridge, a vibrating system including an armature wound with a coil is disposed at an open end area of a magnet with a damper being interposed between the armature and the magnet, and the armature is placed directly under the influence of magnetic flux produced between the ends of the magnet for generating a voltage without using any yoke. The magnet is a hollow cylinder having its interior free of any other magnet material.

10 Claims, 38 Drawing Figures

FIG. 10A
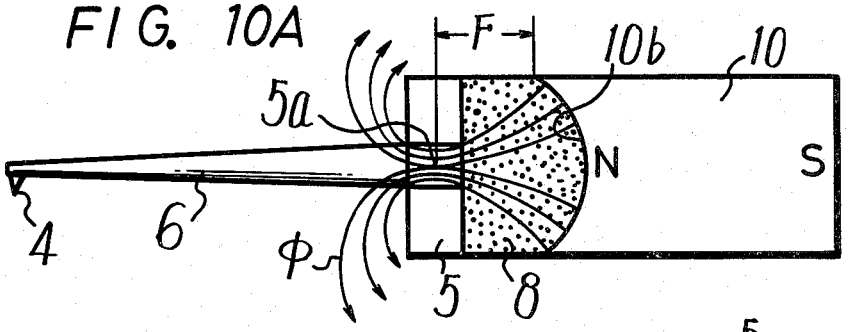
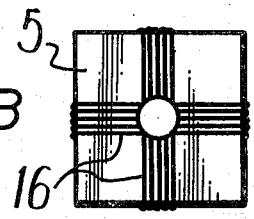
FIG. 10B
FIG. 11A
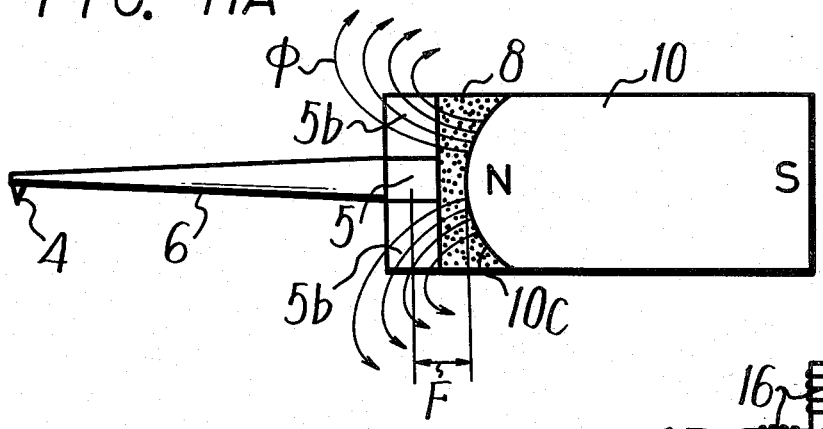
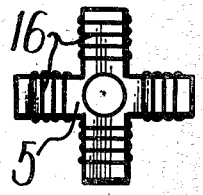
FIG. 11B
FIG. 12
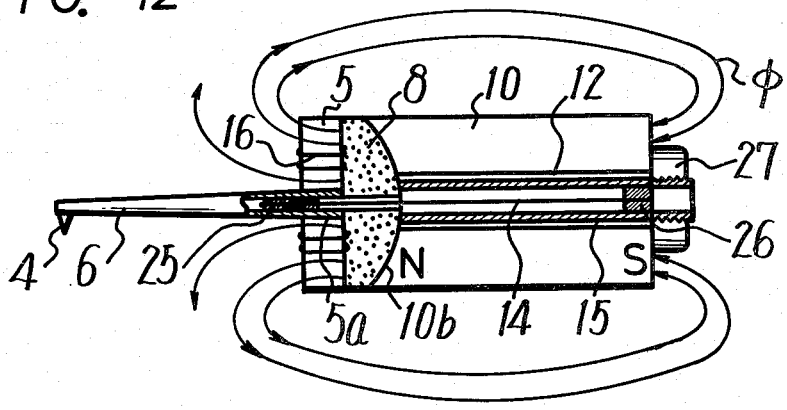

FIG. 13A
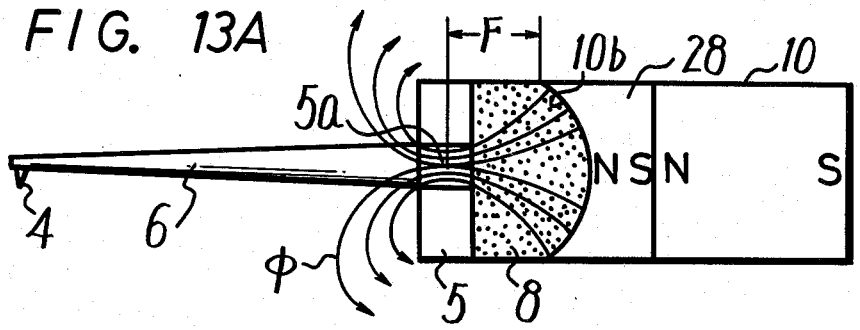
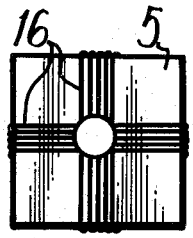
FIG. 13B
FIG. 14A
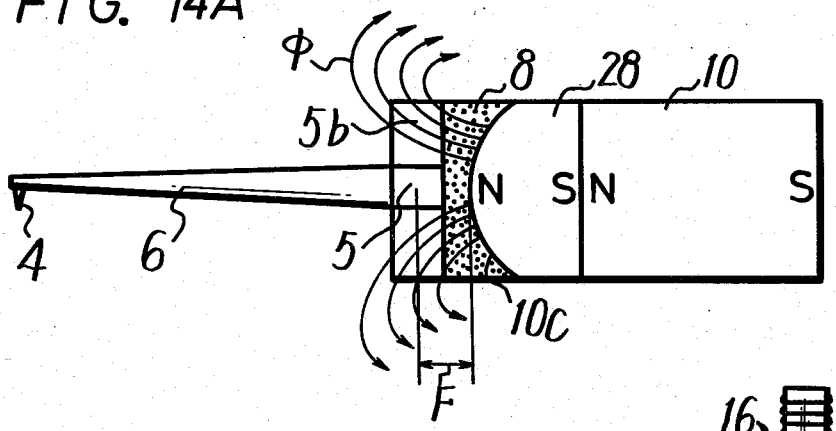
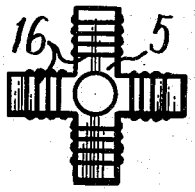
FIG. 14B
FIG. 15
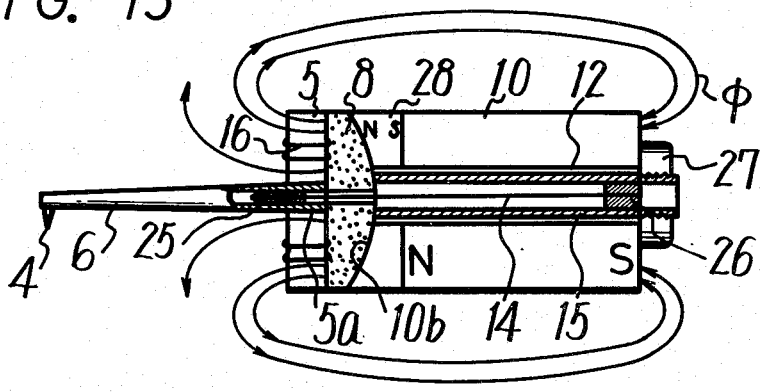

MOVING COIL TYPE PICKUP CARTRIDGE

This is a continuation of U.S. Ser. No. 240,227, filed Mar. 3, 1981, now abandoned.

BACKGROUND OF THE INVENTION

1. Field of the Invention

The present invention relates to a moving-coil type (MC-type) pickup cartridge, and particularly to a pickup cartridge which generates voltage by using the leakage flux of a magnet without using any yoke.

2. Description of the Prior Art

In prior art MC type pickup cartridges, such a construction as shown in FIG. 1 is generally known. In this example, a vibrating system provided with a cantilever is oscillated within a parallel magnetic field.

In FIG. 1, a magnet 1 is prepared and, for example, two yokes 2 and 2*a* are attached to the both ends of the magnet 1 to form a substantially "U" shape, while a pole piece 3 is fixed to the yoke 2*a* at its lower end. A vibrating system 7 including a cantilever 6 with a stylus 4 fixed at its tip and an armature 5 provided thereabout at its rear is inserted into a bore 9 formed through the yoke 2 so that the armature 5 is fixed to one end of the pole piece 3 through a damper 8. Thus, the vibrating system including the armature 5 is forced to vibrate within the parallel magnetic field produced by the yoke 2 and pole piece 3 to induce an output voltage corresponding to the stylus vibration in the coil wound on the armature 5.

FIG. 2 shows another example of the prior art pickup cartridge, in which a cylindrical magnet 10 is provided in place of the magnet 1 and pole piece 3 of FIG. 1 and the vibrating system 7 is fixedly inserted through the damper 8 into a bore 12, which is formed in the magnet 10 at its one end. A front pole piece 11 is disposed in front of the coil-wound armature 5, and the cantilever 6 is inserted through a bore 13 provided in the front pole piece 11, which is in turn fixed to a cartridge body or the like, though not shown. With the pickup cartridge as mentioned above, the armature 5 is held between the yoke 2 and the pole piece 3 as shown in FIG. 1 or between the front pole piece 11 and the magnet 10 as shown in FIG. 2 so that its voltage generation efficiency is good. However, since the cantilever 6 penetrates through the bore 9 or 13 provided in the yoke 2 or the front pole piece 11, it is necessary for the cantilever 6 to have an excessive length. For this reason there is strong possibility that, the cantilever 6 will bend. To prevent such bending, the cantilever must be made thick, and hence the equivalent mass of the vibrating system is increased.

Further, when the cantilever 6 is inserted through the bore 9 or 13 of the yoke 2 or the front pole piece 11, the vibrating system 7 including the cantilever 6 is first fixed to the pole piece 3 or the magnet 10 through the damper 8 and then the yoke 2 or the front pole piece 11 is disposed. Therefore, when disposing the yoke or front pole piece, it is difficult to insert the cantilever into the bore of the yoke 2 or the pole piece 11 through the influence of the magnet 1 or 10 so that the cantilever may be damaged during its fabrication. In addition, a signal having a large amplitude from the record disc affects the cantilever bringing it into contact with the inner wall of the bore to damage the cantilever. Further, since the armature 5 is interposed between yokes or between yoke and magnet to cause vibration within parallel magnetic field for voltage generation, the yoke or the like becomes necessary making the construction more complicated.

SUMMARY OF THE INVENTION

Accordingly, the present invention is concerned with a pickup cartridge free from the aforesaid drawbacks inherent in the prior art pickup cartridge.

It is a primary object of this invention to provide an effective MC type pickup cartridge in which a vibrating system is disposed within the open magnetic field of a magnet without using any yoke.

It is another object of this invention to provide an MC type pickup cartridge in which a magnet is made large and also one surface of the magnet opposite to a record disc is cut out in order to enhance the voltage generating efficiency of a yokeless type pickup cartridge without increasing the equivalent mass of a vibrating system.

It is a further object of this invention to provide an MC type pickup cartridge in which an open end surface of a magnet is curved in order to concentrate magnetic flux on the armature.

It is a further another object of this invention to provide an MC type pickup cartridge in which an auxiliary magnetic pole with one surface thereof curved is used for easy shaping of an open end surface of a magnet.

It is an additional object of this invention to provide an MC type pickup cartridge in which an open end surface of a magnet is slanted so that a large magnet can be used to raise the voltage generating efficiency and a cantilever can make its axial direction substantially coincident with that of the magnet when a pressure is applied to a stylus.

It is yet another object of this invention to provide an MC type pickup cartridge in which coil winding on an armature of a vibrating system is made quite easy.

It is also an object of this invention to provide an MC type pickup cartridge in which a plurality of dampers can be quite easily used by eliminating a yoke or a front pole piece so that damping factor may be freely controlled.

It is a further additional object of this invention to provide an MC type pickup cartridge in which a viscoelastic member is disposed on one portion of a cantilever to change the vibrating mode of the cantilever.

The above and other objects and features of this invention will become manifest from a consideration of the following description taken in connection with the accompanying drawings.

BRIEF DESCRIPTION OF THE DRAWINGS

FIGS. 10A and 10B are a theoretical side view of a pickup and a front view of an armature showing another embodiment of this invention;

FIGS. 11A and 11B are a theoretical side view of a pickup and a front view of an armature used in a further another embodiment of this invention;

FIG. 12 is a cross-sectional side view showing a practical pickup of this invention;

FIGS. 13A and 13B are a theoretical side view of a pickup and a front view of an armature showing a further another embodiment of this invention;

FIGS. 14A and 14B are a theoretical side view of a pickup and a front view of an armature showing a further another embodiment of this invention;

FIG. 15 is a side view of a pickup showing a practical construction of this invention;

FIGS. 23A and 23B are side and front views showing a further embodiment of this invention.

DESCRIPTION OF THE PREFERRED EMBODIMENTS

A description will hereinafter be given on an example of this invention with reference to the drawings.

Figure 3A:
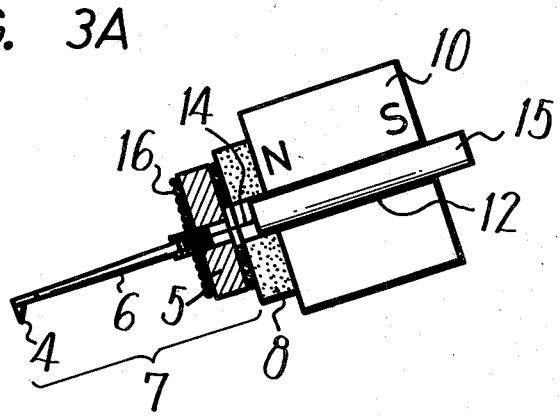
FIG. 3A is a schematic side view showing a theoretical construction of this invention.
Figure 3B:
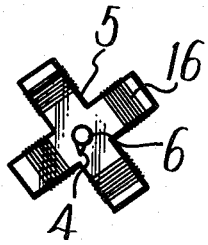
FIGS. 3B and 3C are front views each showing a shape of an armature used in this invention.
Figure 3C:
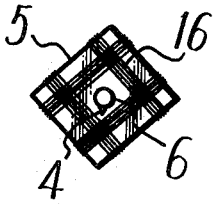

In FIG. 3A, a substantially cylindrical magnet 10 is magnetized at its one end with N-pole and at its other end with S-pole, and a bore 12 is provided penetrating through the center portion of the magnet 10. A suspension holder 15 for holding therethrough a suspension wire 14 is fixedly inserted into the bore 12 of the magnet 10, and the suspension wire 14 is stretched through the suspension holder 15 between one end of a cantilever 6 and the other end of the suspension holder 15. The cantilever 6 is provided with a stylus 4 at its one end and an armature 5 at its other end. The armature 5 is shaped suitably in cross or square and two coils 16 are wound thereon so as to intersect each other at right angles as shown in FIG. 3B or 3C. A vibrating system 7 including the stylus 4, armature 5 and cantilever 6 is attached through a damper 8 to the N-surface of the magnet 10.

Figure 4:
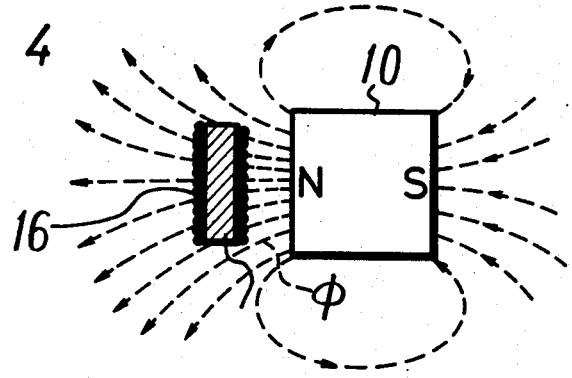
FIG. 4 is a view used for explaining the voltage generating theory of this invention.

With the above-mentioned construction, magnetic flux from the magnet 10 is distributed from the N-pole toward S-pole as shown in FIG. 4. As a result, when the armature 5 of the vibrating system 7 is oscillated within the magnetic flux $\phi$ directed from the N-pole of the magnet 10 to the S-pole, an electromotive force is inevitably induced in the coils 16 wound on the armature 5. It is of course that if a magnet having small permeance factor and large magnetomotive force, such as ferrite magnet or rare earth magnet, is used as the above magnet 10, magnetic flux near the magnetic pole N can be greatly enhanced.

Figure 5A:
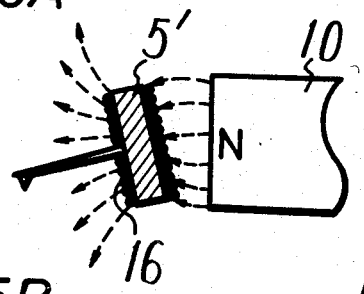
FIGS. 5A, 5B and 5C are schematic side views each showing flux distribution at an open end of a magnet when a magnetic material is used as an armature.
Figure 5B:
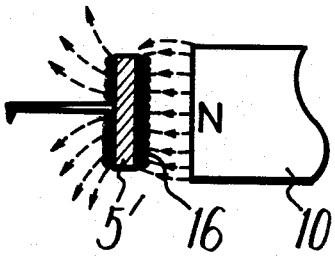
Figure 5C:
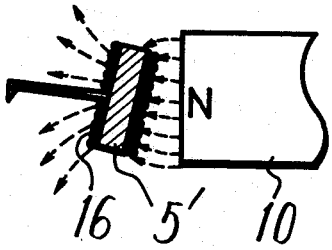

When the above non-magnetic armature 5 is replaced by a magnetic armature 5', the magnetic flux generated from the N-pole of the magnet 10 is concentrated into the magnetic armature 5' as shown in FIG. 5B. As the vibrating system is changed in position, the magnetic flux passing through the armature 5' is changed in volume and direction as shown in FIGS. 5A and 5C so that an output of higher efficiency can be obtained from the coils 16.

Figure 6:
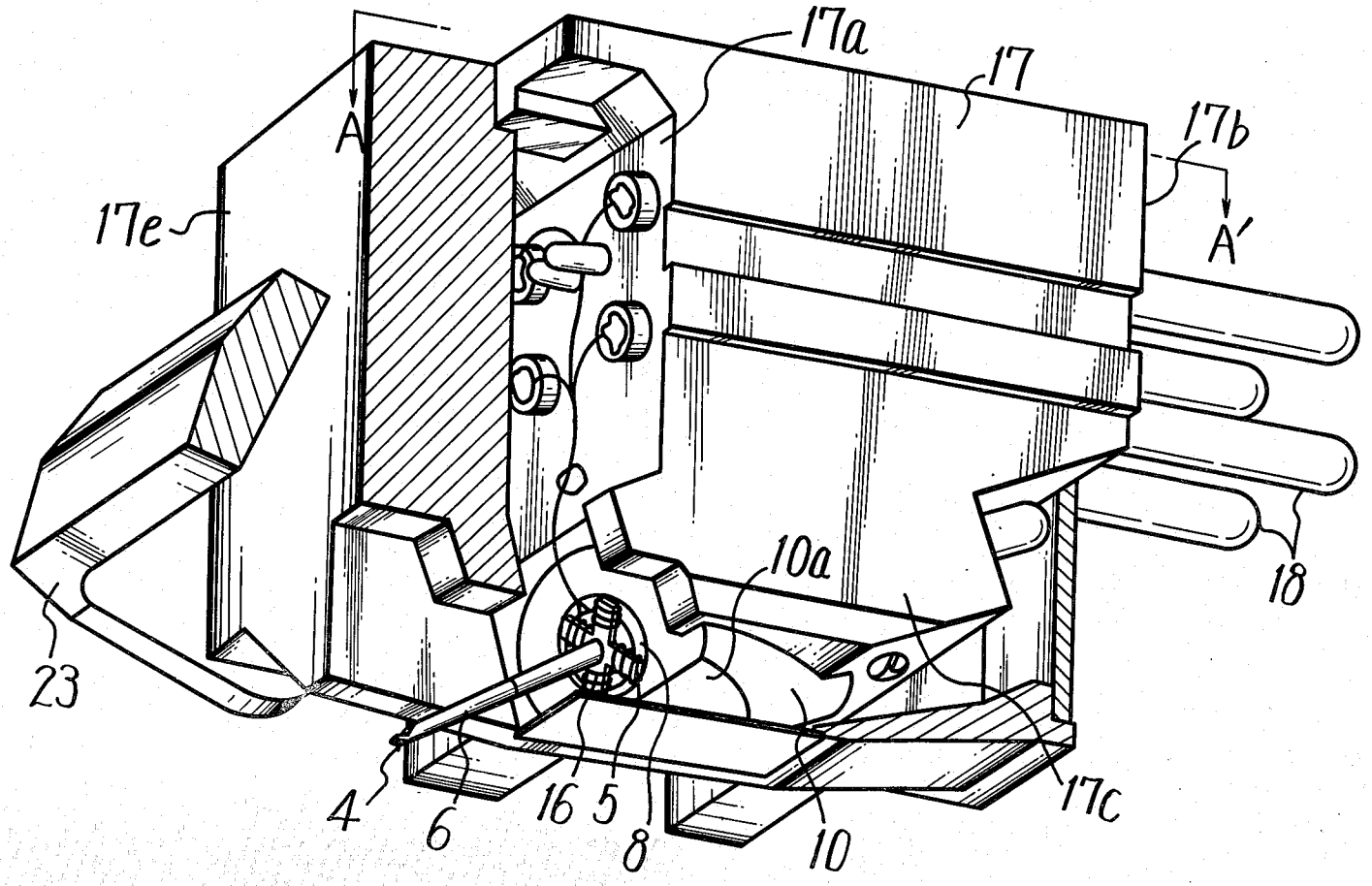
FIG. 6 is a perspective view, partly in vertical section, showing one embodiment of an MC type pickup cartridge constructed by using the voltage generating theory of this invention.
Figure 7:
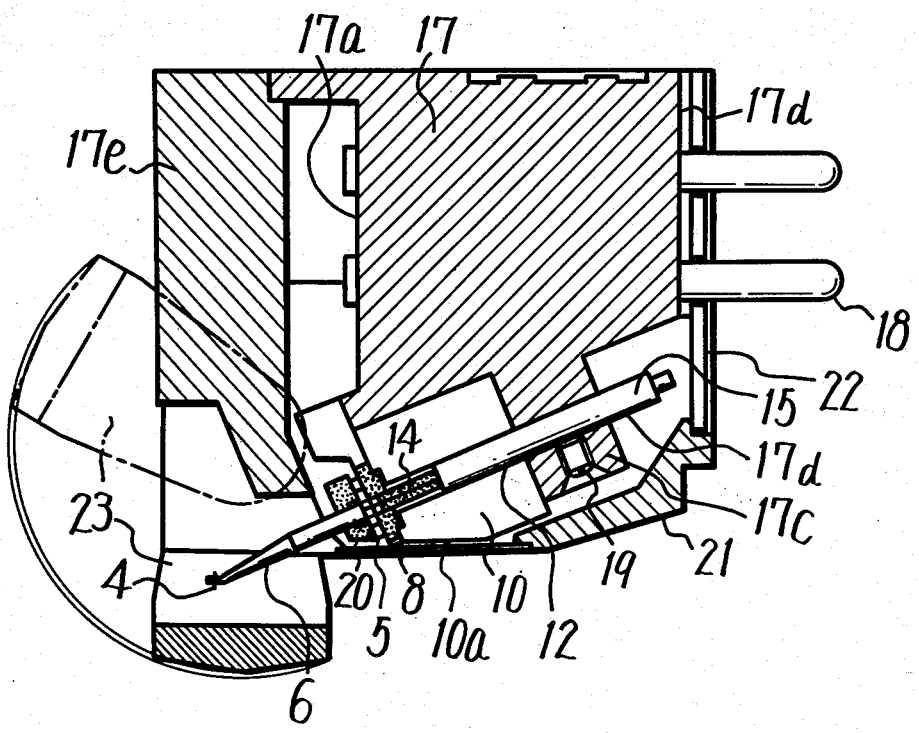
FIG. 7 is a cross-sectional view taken along A—A' line in FIG. 6.

FIG. 6 shows one example of an MC type pickup cartridge formed by using the aforesaid voltage generating theory. In FIG. 6, a casing 17 is made of synthetic resin or the like and output terminals 18 penetrate through the casing 17 from its front end portion **17*a* to its rear end portion 17*b*. A projection 17*c* is provided at the lower end portion of the casing 17, and a bore 17*d* is formed through the projection 17*c* as shown in FIG. 7. The magnet 10 is inserted into the concave portion provided in the projection 17*c* so that the bore 12 of the center of the magnet 10 may be aligned with the bore 17*d* formed in the projection 17*c* of the casing 17. Thus, the suspension holder 15 is inserted through the bores 12 and 17*d* and fixed to the projection 17*c* by a set screw 19. Then, the cantilever 6 having the stylus 4 at its tip and the coil-wound armature 5 at its near end is pushed to the open end of the magnet 10 through a main damper 8 and the suspension wire 14 so that the cantilever 6 is fixed to the casing 17 through the suspension holder 15 which is fixed with the suspension wire 14. Further, in the front of the armature 5 a second damper 20 is fixed to the cantilever 6 or the armature 5. In FIG. 7, 21 indicates a cover and 22 a terminal sheet. At the front end portion 17*a* of the casing 17 a front body 17*e* for rotatably pivoting a needle protecting cover 23** is fixed by means of coupling or the like.

Figure 1:
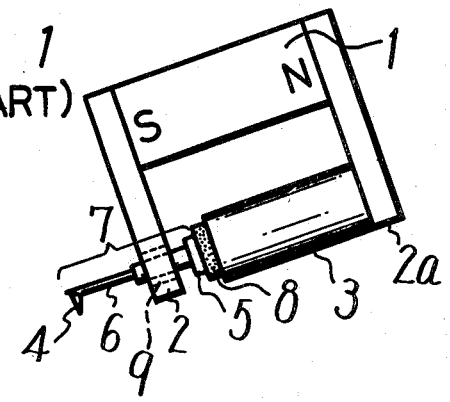
FIG. 1 (PRIOR ART)
FIG. 1 is a schematic side view of a prior art MC type pickup cartridge.
Figure 2:
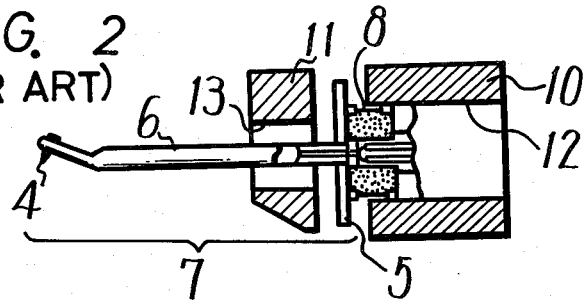
FIG. 2 (PRIOR ART)
FIG. 2 is an enlarged side view of a vibrating portion showing another embodiment of a prior art MC type pickup cartridge.
Figure 9:
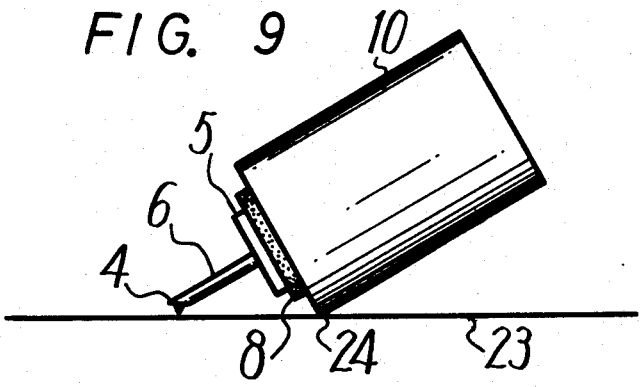
FIG. 9 is a side view used for explaining a draw-back of the construction shown in FIG. 3.
Figure 8:
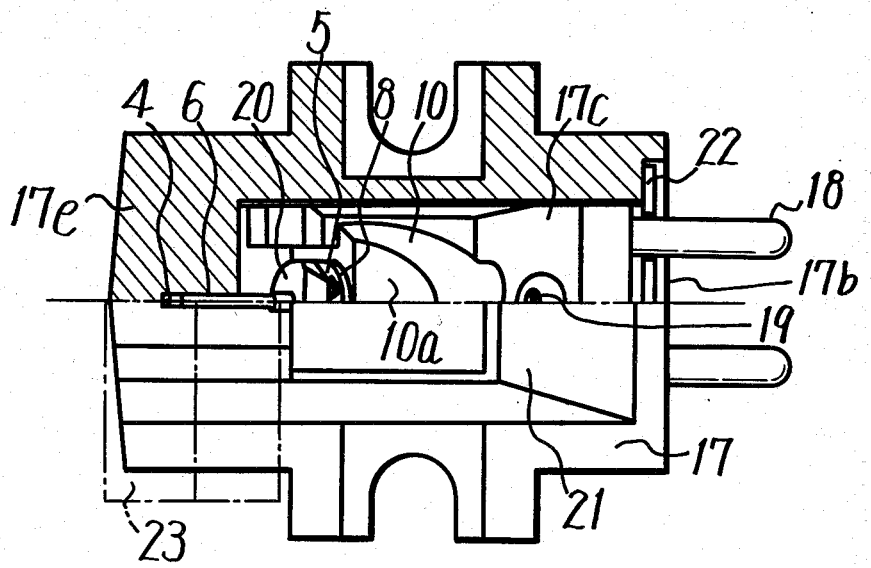
FIG. 8 is a bottom view, partially in section, of FIG. 7.

The magnet 10 is provided at its lower side with a cut surface **10*a* as shown in FIG. 7 by the following reason. In other words, while in FIG. 1 the armature is disposed within the parallel magnetic field for voltage generation, according to the construction as shown in FIG. 4 the magnetic flux is almost not focused, or the armature is placed in a so-called open magnetic field, so that its voltage generating efficiency is lowered by 10 to 20 dB. To resolve the above problem, it is considered to increase the number of turns of the coil on the armature. In this case, however, the mass of the vibrating system is accordingly increased so that its performance is inevitably lowered. Therefore, when a strong and large magnet such as a rare-earth samarium cobalt magnet is used as the magnet 10** to enhance the surface magnetic flux and to increase the voltage generating output, as shown in FIG. 9 one end 24 of the magnet 10 comes to contact with a record disk surface 23' so that the stylus 4 may not correctly trace a sound groove to make its practical use improper. Meanwhile, it is considered to elongate the cantilever to prevent the above drawback, but this procedure makes vibration unfavorable. In order to eliminate the above disadvantage, one portion of the magnet 10 opposite to the record disc surface 23' is cut out to form the cut surface 10*a* as shown in FIGS. 7 and 8 so that the outside diameter and length of the magnet 10 can be increased thereby to set the permeance factor to a desired value and to raise the flux density of the surface opposite to the armature 5. Accordingly, a simple construction can be effectively utilized and also a magnet of large configuration can be used so that the generating output to be obtained may exceed that of the prior art construction of FIGS. 1 and 2. As a result, the number of turns of the armature coil can be made equal to or smaller than the prior art and hence improvement on the tracing performance can be achieved by lowering the weight of the vibrating system. This is the reason why the cut surface 10*a* is provided on the magnet 10.

FIGS. 10 to 12 show other embodiments for producing high output by focusing open magnetic flux from one end of the magnet into wound coil.

In FIG. 10A, one end surface of the magnet 10 is curved in a concave shape so that magnetic flux $\phi$ emitted from the concave surface 10*b* is focused into the center portion 5*a* of the armature 5. Of course, the curvature of the concave surface 10*b* will affect the distance F from the end surface of the magnet 10 to the center portion 5*a* of the armature 5 focused with flux, but by properly selecting these values the magnetic flux $\phi$ can be focused to the center portion 5*a* of the armature 5. In this case, as shown in FIG. 10B the generating coils 16 may be wound near the center of the armature 5.

In the example of FIG. 11A, the end surface of the magnet 10 is convexly curved so that magnetic flux emitted from the convex surface 10*c* of the magnet 10 is concentrated to the exterior periphery 5*b* of the armature 5. Similarly in this case, the distance F from the end surface of the magnet 10 to the flux-concentrated exterior periphery 5*b* of the armature 5 is varied according to the curvature of convex surface 10*c*. However, if these values are properly selected, the magnetic flux can be concentrated to the external periphery 5*b* of the armature 5. In this case, as shown in FIG. 11B the armature 5 may be formed, for example, in a cross shape and wound with the coils 16 near its external periphery 5*b*.

In the above embodiments, the end surface of the magnet is formed in a concave or convex shape. However, it is also possible that the above shapes of the end surface of the magnet are properly combined to form another curved surface having two or more flux concentrating points.

FIG. 12 shows a practical construction of this invention, in which elements corresponding to those of FIGS. 10 and 11 are shown by the same reference numerals with description thereof being omitted. In FIG. 12, the cantilever 6 having the stylus 4 at its tip is inserted into the center portion 5*a* of the armature 5 and the coils 16 are wound on the armature 5 concentrically near its center portion 5*a*. A clamp 25 is fitted to the inside of the cantilever 6 at its side opposite to the stylus side, while another clamp 26 is fitted to the end of the suspension holder 15 inserted through the bore 12 of the magnet 10. Thus, the suspension wire 14 is stretched through the suspension holder 15 between the clamps 25 and 26, and a nut 27 or the like is provided to adjust the compressible rate of the damper 8 which is held between the armature 5 and the concave surface 10*b* of the magnet 10. With the above arrangement, the samarium.cobalt magnet or the like can be simply provided only by forming therein the curved surface 10*b* and the bore 12 before magnetization and also magnetic flux from the magnet 10 can be concentrated to a given point.

In the above embodiments of FIGS. 10 to 12, there is a problem of cutting or processing the open end surface 10*b* or 10*c* of the magnet 10. On the contrary, in the examples shown in FIGS. 13 to 15, the opposite end surfaces of the magnet 10 are formed as parallel, while an auxiliary magnetic pole 28 with one end surface being made concave or convex is disposed between the magnet 10 and the damper 8. The other end surface of the auxiliary magnetic pole 28 is brought into contact with one end surface of the magnet 10. Then, magnetic flux $\phi$ emitted from the concave surface 10*b* of the auxiliary magnetic pole 28 is concentrated to the center portion 5*a* of the armature 5. The other construction is similar to those of FIGS. 10 to 12 so that the description thereof will be cancelled. In the constructions of FIGS. 13 to 15, the magnet 10 is not necessary to have a curved end surface, but it is necessary only to provide an easily finished auxiliary magnetic pole 10*b* or 10*c* and to bring it into contact with the magnet end surface. Further, in case of using a samarium cobalt magnet or the like, the bore 12 can be relatively simply formed therethrough before being magnetized.

Furthermore, in order to remove the drawback encountered when a large magnet is used as mentioned in FIG. 9, upon being applied with stylus pressure, the cantilever can be arranged so that its axial center coincides with that of the magnet, while when applied with no stylus pressure, the cantilever is biased in a direction of a record disc in accordance with the inclination provided at the magnet end surface.

Figure 16:
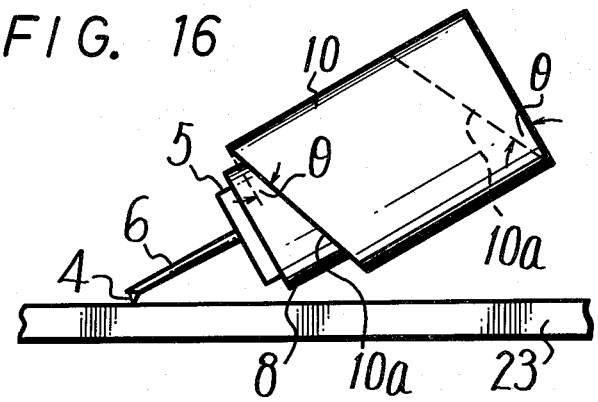
FIG. 16 is a theoretical side view showing one embodiment of a pickup cartridge of this invention.

In other words, as shown in FIG. 16, one end surface of the magnet 10 opposite to the damper 8 is slantwise cut to form a cut surface 10*a*, and a cut angle $\phi$ between the cut surface 10*a* and the damper 8 is so selected that when applied with no stylus pressure, the cantilever is properly biased, but when applied with stylus pressure, the cantilever makes its axial center coincident with the axial direction of the magnet 10. In this case, it is also possible that opposite end surfaces of the magnet 10 are cut out with the same angle $\theta$ as shown by dotted line or only one surface thereof opposite to the coil-wound armature 5 through the damper 8 is made slantwise.

Figure 17:
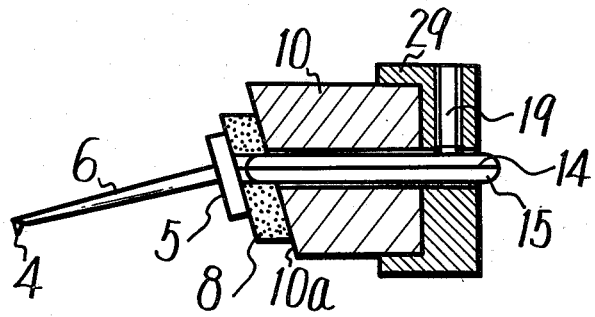
FIG. 17 is a cross-sectional side view showing one embodiment of a pickup cartridge of this invention.

FIG. 17 shows one embodiment of this invention as mentioned in FIG. 16. In this embodiment, a vibrating system including the cantilever 6 and the armature 5 is biased toward the record disc by the inclined angle of the magnet 10, and the axial direction of the suspension holder 15 is adjusted by a set screw 19 which is provided in a supporter 29 disposed at the rear of the magnet 10. It is of course possible that without using the supporter or the like the set screw 19 is provided in a direction perpendicular to the axial direction of the magnet 10 to carry out lateral adjustment of the suspension holder 15. In the above embodiment of FIG. 17, a magnet of large size can be used and one portion of the magnet is not brought into contact with the record disc surface only by slantly cutting the magnet end surface.

In addition, when the stylus pressure is applied to the cantilever, the cantilever axis is aligned with the magnet axis so that magnetic flux can be uniformly applied to the armature and also the stylus pressure is stabilized. As a result, a pickup cartridge having a large output can be obtained.

Figure 18:
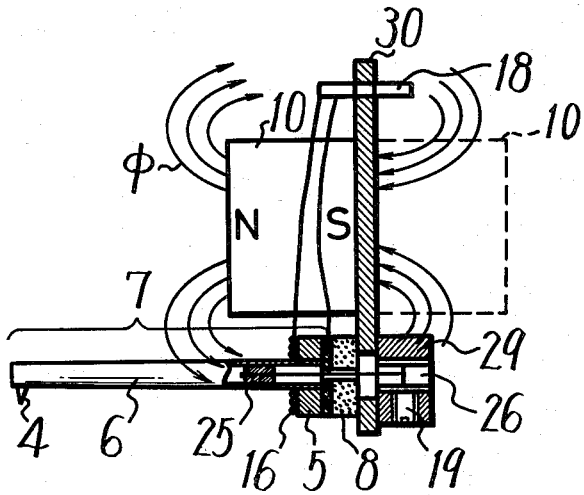
FIG. 18 is a cross-sectional side view showing another embodiment of a pickup cartridge of this invention.

FIG. 18 shows another embodiment of this invention wherein the magnet 10 can be made larger. The magnet 10 is disposed above a supporting plate 30 (it can also be disposed at a position shown by dotted line) and the armature 5 of the vibrating system 7 is placed in the path of the magnetic flux directed from the pole N to the pole S.

In this invention, the equivalent mass of the vibrating system is lessened and the weight of the whole cartridge is selected to about 4.7 grams. Accordingly, when used in a pickup arm of low mass and high sensibility, the pickup cartridge of this invention is not affected by warping, eccentricity, etc. of a record disc. If the effective mass is made small and compliance is enhanced, the tracing ability of the cartridge is improved and the reproduced frequency range is enlarged, but problems relating to resonance phenomenon of the vibrating system or the like are not resolved and a peak appears in higher frequency range. Therefore, in the embodiments shown in FIGS. 6 to 8, the cantilever is constructed in a duplex manner and a plurality of dampers are used to damp the middle and low frequency range and the high frequency range respectively, thus obtaining a frequency characteristic which is linear within a range up to 60 Hz. In this invention, the yoke 2 and the front pole piece 11 are not used in front of the armature 5, so that plural dampers can be effectively disposed. The plural-damper construction will be next described with reference to FIGS. 19 to 21.

Figure 19:
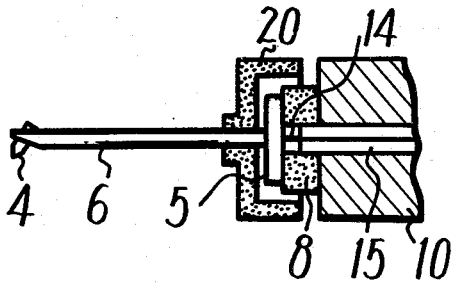
FIG. 19 is a cross-sectional side view showing a construction of a vibrating system of this invention.
Figure 20:
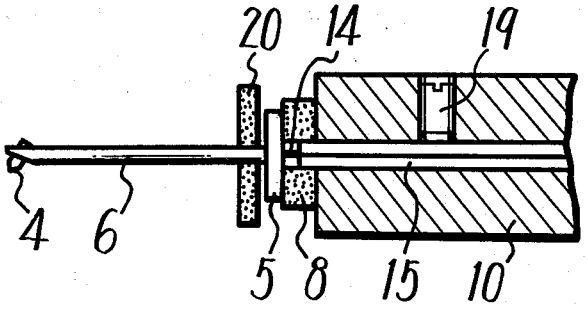
FIG. 20 is a cross-sectional side view showing another embodiment of this invention.
Figure 21:
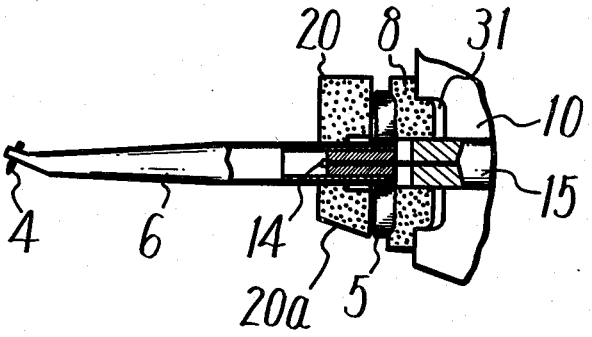
FIG. 21 is an enlarged cross-sectional side view showing the vibrating portion of FIG. 7.

In the example of FIG. 20, a second damper 20 is fitted to the cantilever 6 in front of the armature 5. This second damper 20 can properly select its external diameter dimension, shape, material quality, etc. in accordance with its objects. In the example of FIG. 20, the second damper 20 is of a plate-shape such as circular, square or the like. As the second damper 20, however, it is also possible to use a concave damper surrounding the armature 5 as shown in FIG. 19. FIG. 21 is an enlarged cross-sectional view showing the damper portion of FIG. 7, in which the first damper 8 is inserted into the recess provided in the open end surface of the magnet 10 and one end surface of the second damper 20 is cut to form a cut surface 20*a* with the remaining parts being equal to those of FIG. 20.

Being passable through the cantilever 6 from the direction of stylus 4, the second damper 20 with the above construction can be easily assembled. Different from the first damper 8, the above second damper 20 can be disposed on the vibrating system, for example, the cantilever 6 at its given position where an optimal effect is obtained, without touching to portions other than the vibrating system, so that the damping of high frequency range is effected by only the second damper 20 to enhance a high-frequency damping effect. In addition, since the second damper 20 is not in contact with the portions other than the vibrating system, it has no elasticity control effect associated to low-frequency damping, so that compliance will not be changed by the second damper 20. The compliance viewing from the side of the stylus 4 is determined by the first damper 8 so that an aimed compliance can be obtained by only selecting hardness of the damper 8.

Further, the mass of the vibrating system affects directly the middle and high frequency characteristics so that increase in mass by the second damper 20 must be considered. However, the elements practically considered as the added mass of a vibrating system are quite small and also these elements consist of successive connection of resistor and mass. Therefore, in an actual case they will not added, as they are, to the mass of vibrating system and damping effect or the like is different dependent on the mass of the second damper 20 so that a relatively flat frequency characteristic can be obtained.

According to the above construction, even if a pickup cartridge is made as of a high-compliance type, the high-frequency damping is not insufficient as in the prior art and hence a flat frequency characteristic is obtainable. Also, from a structural point of view, the second damper is only added to the prior art construction, so that no particular accuracy is required and its assembly is easy with the result that its commercial value is increased.

Further, a cantilever has a spring characteristic with respect to its lengthwise direction thereby representing a proper vibrating mode, in which stylus and armature positions correspond to node and the middle of cantilever corresponds to an antinode. In such a case, the amplitude at the stylus side will not be transmitted to the armature position with the same amplitude and hence the output level will be lowered. The above frequency band is normally in or over the intermediate sound range, so that the frequency characteristic is sagged in its middle. In order to reduce the above sagging characteristic, it is well known to use a material having high stiffness as the cantilever. However, such an expensive material can not always be used from an economical point of view and hence the tone must have been sacrificed. Accordingly, this invention is to improve the sagging characteristic by changing a vibrating mode with a mass being added to the intermediate position of a cantilever corresponding to the antinode of the vibrating mode. In short, if a consideration is taken into only a portion to which a mass is added, a mechanical impedance of this portion becomes large to make it difficult for the above portion to become an antinode, so that Q of the vibrating mode is effectively lowered. Consequently, the sag portion can be made small. The construction for the above will be described with reference to FIGS. 22 and 23.

Figure 22A:
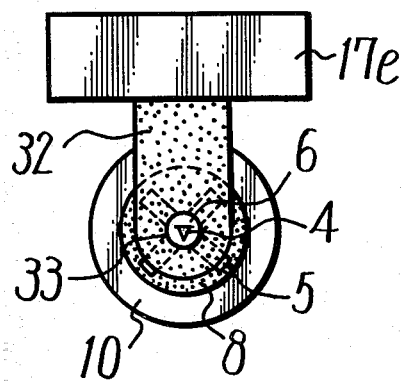
FIGS. 22A and 23B are side views and front views, respectively, showing a further another embodiment of this invention.
Figure 22B:
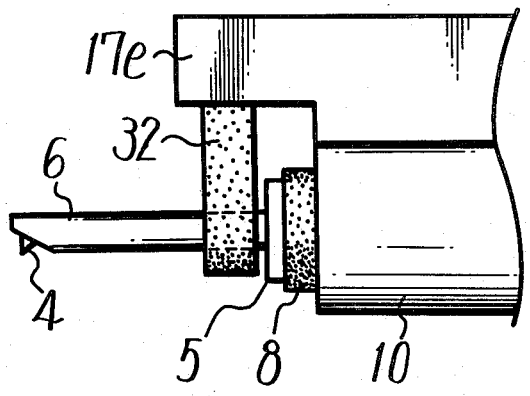
Figure 23A:
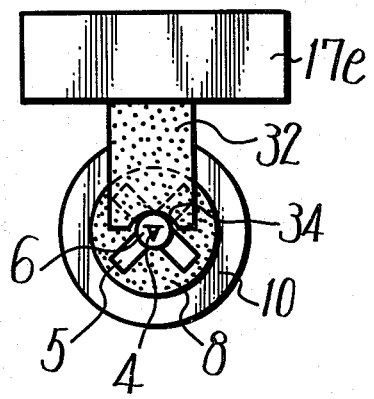
Figure 23B:
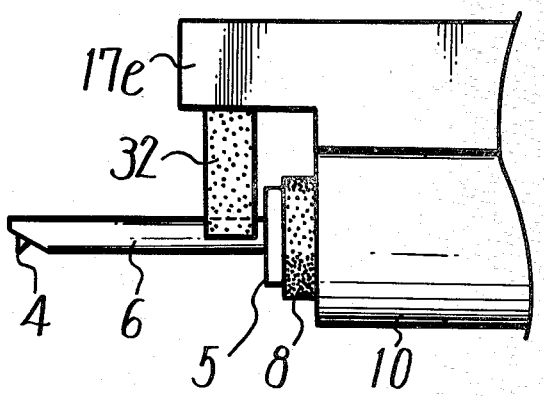

In the example of FIG. 22, an auxiliary damper 32 is used as an adding mass, which is provided with a bore 33 to penetrate therethrough a cantilever 6. The auxiliary damper 32 is made of a visco-elastic material such as butyl rubber or silicon rubber. This auxiliary damper 32 can select an arbitrary position on the cantilever in its length direction in accordance with the desired characteristic. In this example, 17*e* designates an auxiliary damper supporting base, which is extended from the cartridge main body. The example shown in FIG. 23 has the entirely same operation, object and effect as those of FIG. 22. However, the auxiliary damper 32 is provided with a semi-circular portion 34 at its bottom, which is brought into contact with the cantilever 6 to act thereon as the adding mass.

Further, in this invention, an attempt is made to simplify the assembly of the vibrating system. In the prior art vibrating system 7 shown in FIG. 3, the stylus 4 is fixed to the tip of the cantilever 6 while the armature 5 is disposed thereon at its rear side, and the suspension wire 14 drawn out from the rear of the cantilever 6 is fixed to the suspension holder 15 thereby providing a sub-assembly member. Finally, the coils 16 are wound on the armature 5. In this case, however, the suspension holder 15 is caused to disturb the coil winding operation to make it difficult. For example, when a cross-type armature is used and a coil is wound on one yoke of the armature, a winding operator is required to bend the suspension holder 15 toward the other yoke so as not to touch with the winding coil so that the winding operation is disturbed. On the contrary, when winding a coil on the other yoke which is perpendicular to the one yoke, the suspension holder 15 is similarly bent toward the opposite yoke. In these cases, the suspension wire 14 happens to be broken and so on so that the number of winding process is increased and also proportion defective becomes high.

Figure 24A:
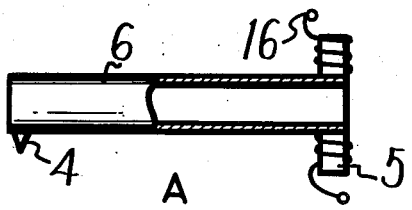
FIGS. 24A and 24B are side views respectively showing a vibrating section partial in cross section and a holding section for explaining a method of assembling a vibrating system of this invention.
Figure 24B:
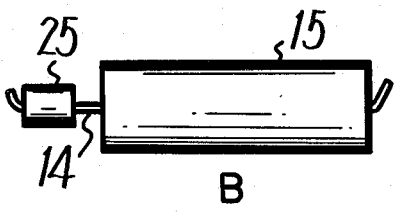
Figure 25:
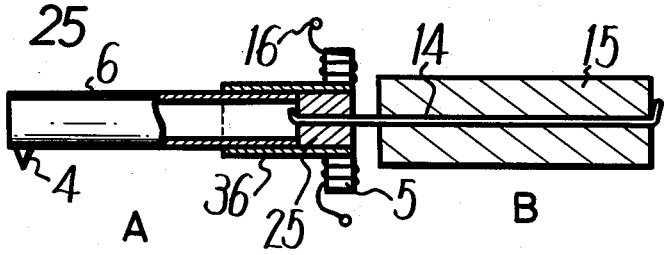
FIGS. 25 and 26 are side view each showing the assembled state of a vibrating system of this invention.
Figure 26:
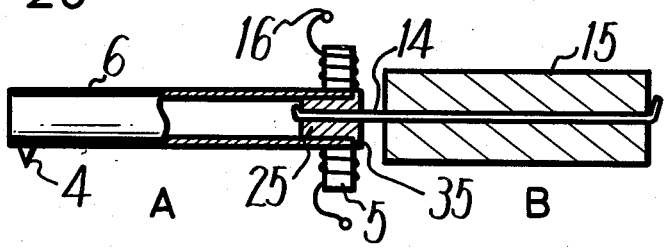

Thus, as shown in FIG. 24, the aforesaid sub-assembly member is divided into a vibrating system section A including the cantilever 6 and the armature 5 and a holding section B including the suspension holder 15. At first, the winding operation is carried out at a condition of vibrating system section A only. After the above winding operation is finished, a spacer 25 for defining the position of the holding section B is applied with an adhesive agent and then inserted into the cantilever rear portion. In the example of FIG. 25, the cantilever 6 is of a double construction having an exterior pipe portion 36. The cantilever 6 is not extended to the last end but made to have a length to define a position for receiving the spacer 25. Accordingly, the operator can do quite easy coupling operation between the vibrating system section A and the holding section B for a short time with no failure. The last end of the main cantilever 6 will function as a stopper in this example In the example of FIG. 26, the cantilever 6 is of a normal construction but a spacer of special shape is used. In other words, the spacer 25 is provided with a flange 35 to define the spacer position.

The above constructions, can be separately used in accordance with the cantilever shape. According to the above cantilever assembling method, upon winding the coil, it is not required to purposely keep the wire away from the suspension assembly so as not to be cut by touching thereto at every winding operation so that the coil winding efficiency is extremely improved. The suspension wire itself is also seldom broken and its proportion defective can also be greatly reduced. Further, the suspension assembly can be easily coupled to the vibrating system such as cantilever and in this case such a tool as required in the prior art is unnecessary.

Figure 27:
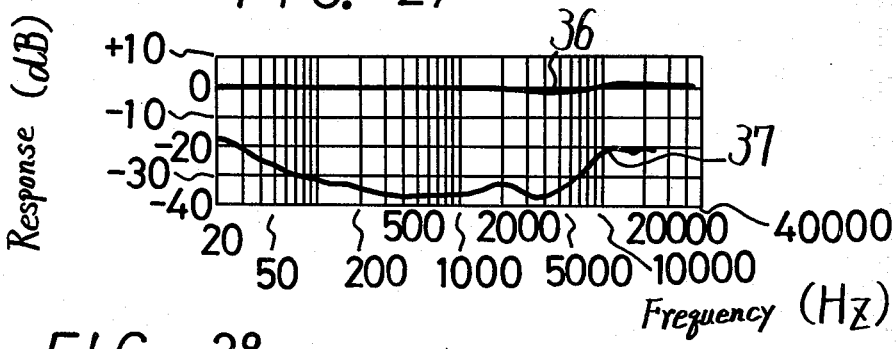
FIG. 27 is a graph showing frequency characteristics of this invention.
Figure 28:
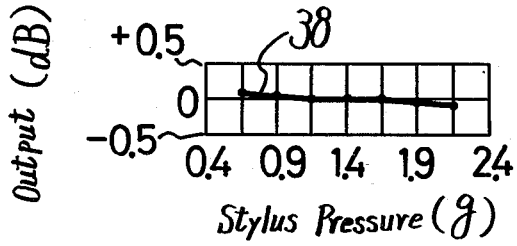
FIG. 28 is a graph showing an output characteristic with respect to variation in stylus pressure.

Output voltage and crosstalk frequency characteristics according to the above pickup cartridge construction are shown in FIG. 27, in which an output characteristic 36 is nearly flat up to 40 KHz or more, and a crosstalk characteristic 37 is limited to −20 dB or less. Further, as shown in FIG. 28 an output voltage characteristic 38 relative to stylus pressure can be made substantially flat in a range of about 0.5 g to 2 g of the latter.

It will be apparent that many modifications and variations may be effected without departing from the scope of the novel concepts of this invention.

We claim as our invention:

1. A moving-coil type pickup cartridge comprising:

a vibrating system including a cantilever having a stylus fixed thereto at its one end and coil-wound armature fixed thereto at its other end;

a suspension holder for holding a suspension wire, said suspension wire being fixed at one end thereof to said cantilever and at the other end thereof to said suspension holder;

an elongated hollow cylindrical magnet magnetized in its lengthwise direction said magnet having its interior free of any other magnet material to maintain a flux path originating at one open end of said magnet and passing about the exterior of said magnet to the other open end, thereof said vibrating system being disposed at said one open end of said magnet and having said armature disposed within said flux path, and a damper interposed between said armature and said one open end of said magnet.

2. A moving-coil type pickup cartridge as set forth in claim 1, in which said vibrating system is fixed to a supporting member provided at one end of said magnet.

3. A moving-coil type pickup cartridge as set forth in claim 1, in which the one open end surface of said magnet is curved.

4. A moving-coil type pickup cartridge as set forth in claim 3, in which the curved surface of said magnet is made as convex.

5. A moving-coil type pickup cartridge as set forth in claim 3, in which the curved surface of said magnet is made as concave.

6. A moving-coil type pickup cartridge as set forth in claim 1, in which an auxiliary magnet piece magnetized in its lengthwise direction and having one end thereof curved is attached to the one open end surface of said magnet.

7. A moving-coil type pickup cartridge as set forth in claim 6, in which the curved surface of said auxiliary magnetic pole in opposition to said armature is made as concave.

8. A moving-coil type pickup cartridge as set forth in claim 6, in which the curved surface of said auxiliary magnetic pole in opposition to said armature is made as convex.

9. A moving-coil type pickup cartridge as set forth in claim 1, in which said one open end surface of said magnet is cut at an incline.

10. A moving-coil type pickup cartridge as set forth in claim 9, in which axial center of said cantilever coincides with the axial direction of said magnet when said stylus is applied with a sytlus pressure.

* * * * *

UNITED STATES PATENT AND TRADEMARK OFFICE

CERTIFICATE OF CORRECTION

PATENT NO. : 4,455,639
DATED : June 19, 1984
INVENTOR(S) : Naohisa Aoki and Akira Matuki It is certified that error appears in the above-identified patent and that said Letters Patent are hereby corrected as shown below:

On the cover sheet [75] the name of the inventor should read AKIRA MATUKI.

Signed and Sealed this

*Thirtieth* Day of *April 1985*

[SEAL]

*Attest:*

DONALD J. QUIGG

*Attesting Officer* *Acting Commissioner of Patents and Trademarks*